US006843174B2

(12) United States Patent
Berlingen et al.

(10) Patent No.: US 6,843,174 B2
(45) Date of Patent: Jan. 18, 2005

(54) SHEET-PROCESSING ROTARY PRINTING PRESS WITH A SHEET GUIDING DEVICE

(75) Inventors: Detlev Berlingen, Heidelberg (DE); Frank Gunschera, Nussloch (DE); Claudius Haas, Nussloch (DE); Bettina Remarque, Angelbachtal (DE); Steffen Siegemund, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/706,831

(22) Filed: Nov. 12, 2003

(65) Prior Publication Data

US 2004/0094053 A1 May 20, 2004

(30) Foreign Application Priority Data

Nov. 11, 2002 (DE) ..... 102 52 236

(51) Int. Cl.[7] ..... B41F 23/04
(52) U.S. Cl. ..... 101/232; 101/424.2; 101/216
(58) Field of Search ..... 101/216, 232, 101/424.2, 240; 271/198, 204

(56) References Cited

U.S. PATENT DOCUMENTS

| | | | | |
|---|---|---|---|---|
| 4,085,930 A | | 4/1978 | Weisgerber et al. | 271/204 |
| 6,038,998 A | * | 3/2000 | Platsch | 118/46 |
| 6,708,615 B2 | * | 3/2004 | Sugiyama | 101/424.2 |

FOREIGN PATENT DOCUMENTS

| | | |
|---|---|---|
| DE | 25 44 566 A1 | 4/1977 |
| DE | 44 26 749 A1 | 2/1996 |

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A sheet-processing rotary printing press includes a sheet guiding device over which sheets are to be pulled in a processing direction. The guiding device has a stationary first guide surface and a withdrawable second guide surface. The withdrawable second guide surface follows the stationary first guide surface in the processing direction, and forms a pocket with the first guide surface. The guiding device further includes a molded part received in the pocket and forming a third guide surface for bridging over the pocket.

8 Claims, 4 Drawing Sheets

SHEET-PROCESSING ROTARY PRINTING PRESS WITH A SHEET GUIDING DEVICE

BACKGROUND OF THE INVENTION

Field of the Invention

The invention relates to a sheet-processing rotary printing press with a guiding device over which the sheets are pulled or dragged in a processing direction. A locally fixed first guide surface is formed on the guiding device. A withdrawable second guide surface is formed on the guiding device. The second guide surface follows the locally fixed first guide surface in the processing direction and forms a wedge or pocket with the locally fixed first guide surface.

A rotary printing press of that general type is disclosed, for example, in German Published, Non-Prosecuted Patent Application DE 25 44 566, corresponding to U.S. Pat. No. 4,085,930. The withdrawable guide surface disclosed in those documents serves for adapting the guiding device to different formats of the processed sheets. It bridges over a gap which otherwise occurs between the stationary guide surface and a braking device which retards the sheets to a depositing speed. Regardless of the respective format of the processed sheets, it is always disposed upstream and in the immediate vicinity of a delivery pile or stack formed therefrom and the position thereof is adaptable in turn to the respective format for that purpose.

The withdrawable guide surface is formed on a correspondingly withdrawable guide plate which, at an end of the stationary guiding surface facing towards the delivery pile, is partially stored underneath the guide surface and forms a wedge or pocket therewith.

An air cushion which is usually formed in a gap between a guiding device of that general type and the sheet pulled or dragged thereover is fed by a supply of sheet-carrying air into the gap, in particular in the case of sheets printed on both sides thereof. Such an actively formed air cushion serves for guiding or carrying the sheets along the guiding device without making any contact with the latter. Disturbances in the flow field of the air cushion can, however, have a detrimental effect with regard to smooth running or travel of the sheets. A corresponding disturbance or disruption is established, in particular, in the aforementioned wedge or pocket.

SUMMARY OF THE INVENTION

It is accordingly an object of the invention to provide a sheet-processing rotary printing press with a sheet guiding device, which overcomes the hereinafore-mentioned disadvantages of the heretofore-known devices of this general type and in which the guiding device is configured in such a way that smooth running of the sheets is established along the guiding device.

With the foregoing and other objects in view, there is provided, in accordance with the invention, a sheet-processing rotary printing press, comprising a sheet guiding device over which sheets are pullable in a processing direction. The guiding device is formed with a stationary first guide surface and a withdrawable second guide surface. The withdrawable second guide surface follows the stationary first guide surface in the processing direction and forms a pocket with the first guide surface. The guiding device includes a molded part received in the pocket and forming a third guide surface for bridging over the pocket.

In accordance with another feature of the invention, the molded part has air outlet openings passing through the third guide surface, and air inlet openings communicating with the air outlet openings.

In accordance with a further feature of the invention, there is provided a supply system for providing, during operation, a carrying-air flow and a powdering agent entrained thereby, and for further providing a fluidic connection to the air inlet openings.

In accordance with an added feature of the invention, the molded part is formed with chambers communicating with the air outlet openings and the air inlet openings.

In accordance with an additional feature of the invention, the molded part has a hollow profile. Dividing walls are received in the hollow molded part and serve for subdividing the hollow molded part into chambers communicating with the air outlet openings and the air inlet openings.

In accordance with yet another feature of the invention, the molded part is formed with slots through which the dividing walls are insertable into the molded part.

In accordance with yet a further feature of the invention, a respective one of the chambers is formed with a baffle surface facing towards the respective air inlet opening for the one chamber.

In accordance with a concomitant feature of the invention, an obstruction to flow is provided in a respective one of the chambers.

Thus, in order to achieve the object of the invention, a molded part is disposed in the afore-mentioned pocket, forming a third guide surface that bridges over the pocket.

The cross section of the molded part is preferably formed in such a way that only a fluidically relatively non-critical joint is formed in place between the stationary first guide surface and the third guide surface. In addition, the end of the cross section directed in the pulling or dragging direction runs out into a point so that, between the withdrawable second guide surface and the third guide surface, only a virtually unnoticeable pocket still remains. In the case of a generally convexly curved course of the withdrawable second guide surface, in the region thereof adjoining the stationary first guide surface and a following transition of the withdrawable second guide surface into a flat, generally horizontal course, the afore-mentioned cross section preferably tapers in a knife-sharp manner at the end thereof directed or pointing in the pulling direction and is dimensioned in such a way that the cutting edge produced by the tapering is located at the transition from the curved to the flat course of the withdrawable second guide surface.

The molded part permits avoidance of a flow-technology problem zone which has existed over a long period of time in guiding devices adjustable to different formats of the sheets.

However, in a preferred further development, as explained in greater detail below, farther reaching advantages than the foregoing result with regard to applying a powdering agent to the processed sheets.

Other features which are considered as characteristic for the invention are set forth in the appended claims.

Although the invention is illustrated and described herein as embodied in a sheet-processing rotary printing press with a sheet guiding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
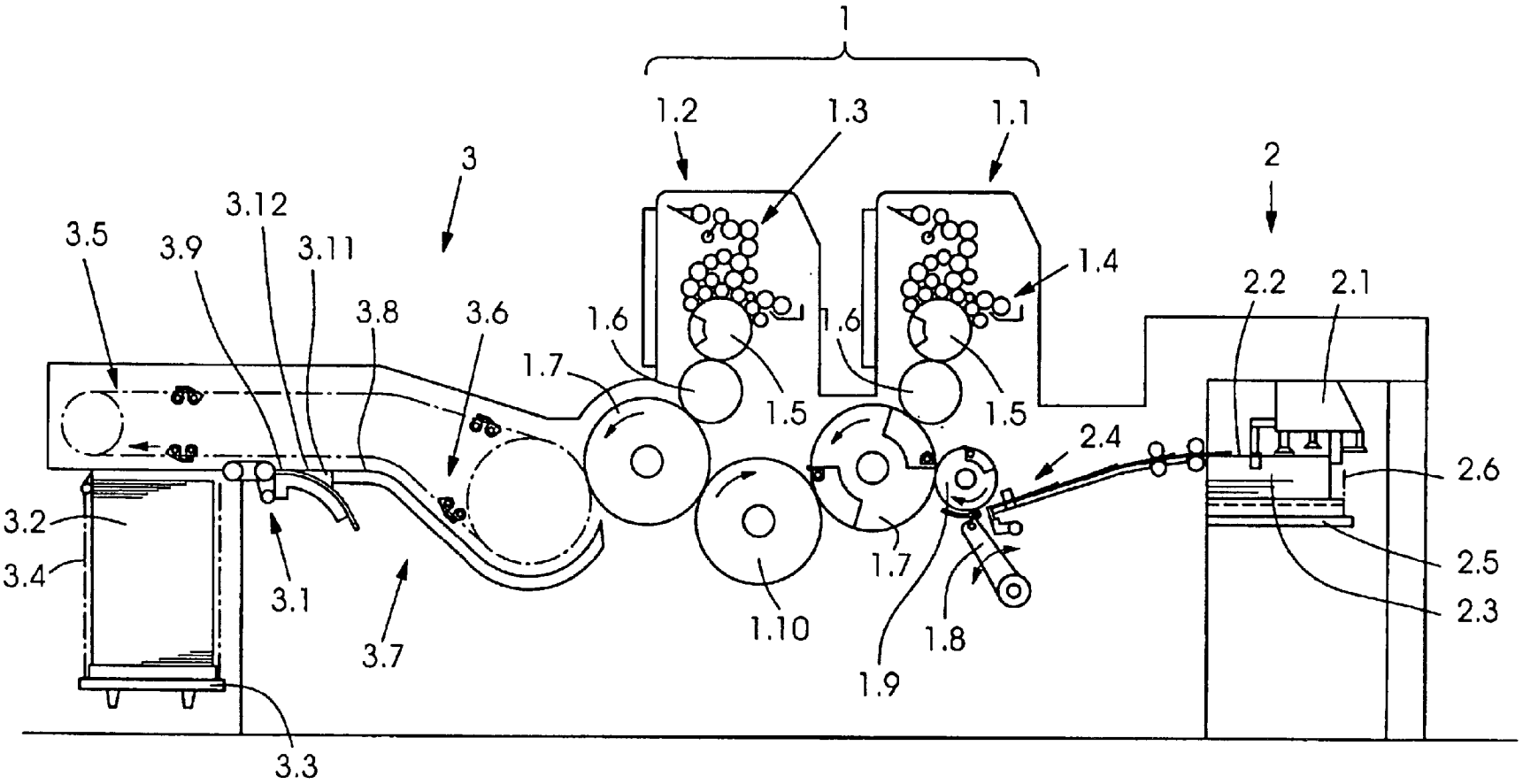
FIG. 1 is a diagrammatic, side-elevational view of a sheet-processing rotary press having a sheet guiding device over which processed sheets are pulled or dragged, the guiding device having a stationary and a withdrawable guide surface together forming a wedge or pocket into which a molded part is inserted.

Referring now to the figures of the drawings in detail and first, particularly, to FIG. 1 thereof, there is seen a diagrammatic illustration of a sheet-processing rotary printing press including a press section 1 with, for example, two processing stations in the form of printing units 1.1 and 1.2, so that two colors can be printed therewith. A further printing unit must be provided for every further color. A respective further processing station must be provided for further process steps, such as varnishing, intermediate drying, perforating and so forth. In the embodiment which is illustrated by way of example, the printing units 1.1 and 1.2 operate in accordance with the wet offset process and, accordingly, each of the printing units 1.1 and 1.2 respectively includes an inking unit 1.3 and a dampening unit 1.4, a plate cylinder 1.5 connected thereto, a blanket cylinder 1.6 which rolls on the plate cylinder during operation, and an impression cylinder 1.7 carrying a respective sheet 2.2.

In order to load the printing units 1.1 and 1.2 with the sheets 2.2, a feeder 2 is provided which, through the use of a separating or singling device 2.1, picks off a respective topmost sheet 2.2 from a pile or stack 2.3 and transfers it to a transport and aligning device 2.4, which aligns a sheet respectively leading in the processing direction from the sheets separated into an overlapping or shingle-stream formation, after the transport thereof in a direction towards leading-edge stops that is performed, in particular, by a suction tape feed table, on the leading-edge stops and on at least one lateral stop.

A swinging pregripper 1.8 associated with the first processing station, in this case the printing unit 1.1, picks up the respectively aligned sheet 2.2 and transfers it to a feed drum 1.9, which in turn transfers it to the impression cylinder 1.7 of the printing unit 1.1. After the sheet 2.2 passes through the printing nip of the printing unit 1.1, the impression cylinder 1.7 of the latter transfers the sheet 2.2 to a transfer device connected between the impression cylinders 1.7 of the two printing units 1.1 and 1.2 in the form of a sheet-guiding drum 1.10. In the case of a printing press constructed for recto/verso printing, a reversing or turning device, which can be converted between recto printing operation and recto/verso printing operation, is provided instead. The impression cylinder 1.7 of the printing unit 1.2 picks up the sheet 2.2 from the sheet-guiding drum 1.10, guides it through the further printing nip and then transfers it to an endless conveyor 3.5 disposed in a delivery 3. The endless conveyor 3.5 pulls the sheets 2.2 in a conveying direction along a conveying section at a processing speed. After the sheets 2.2 have passed through the conveying section, the endless conveyor 3.5 transfers them to a sheet brake 3.1, which retards the sheets 2.2 to a depositing speed, and finally releases them in order to form a delivery pile or stack 3.2.

The endless conveyor 3.5 is equipped with gripper bars 3.6, on which grippers are disposed. The grippers are normally closed under spring force and, with rotation of a gripper shaft that bears the grippers, through the use of a cam follower configuration disposed thereon and a gripper opening cam deflecting the latter appropriately, are opened temporarily as they pass the latter, in a non-illustrated manner.

During continuous printing, the production level on the stack 2.3 in the feeder 2, that is to say the height of the respective topmost sheet 2.2, and the drop height in the delivery 3 of the sheets 2.2 released by the sheet brake 3.1 are maintained through the use of appropriate tracking of respective platforms 2.5 and 3.3 respectively carrying the stack 2.3 and the printed-material stack 3.2. This is accomplished through the use of respective lifting mechanisms, of which only lifting chains 2.6 and 3.4 carrying the platforms 2.5 and 3.3 are illustrated.

The gripper bars 3.6 of the endless conveyor 3.5 drag the sheets 2.2 picked up from the impression cylinder 1.7 of the printing unit 1.2 along a guiding device 3.7 which is assigned to the afore-mentioned conveying section. The guiding device 3.7 forms a stationary first guide surface 3.8 and a withdrawable second guide surface 3.9. The second guide surface 3.9 follows the first guide surface 3.8 in the processing direction and forms a pocket 3.10 with the first guide surface 3.8 (note FIG. 2, in particular).

Figure 2:
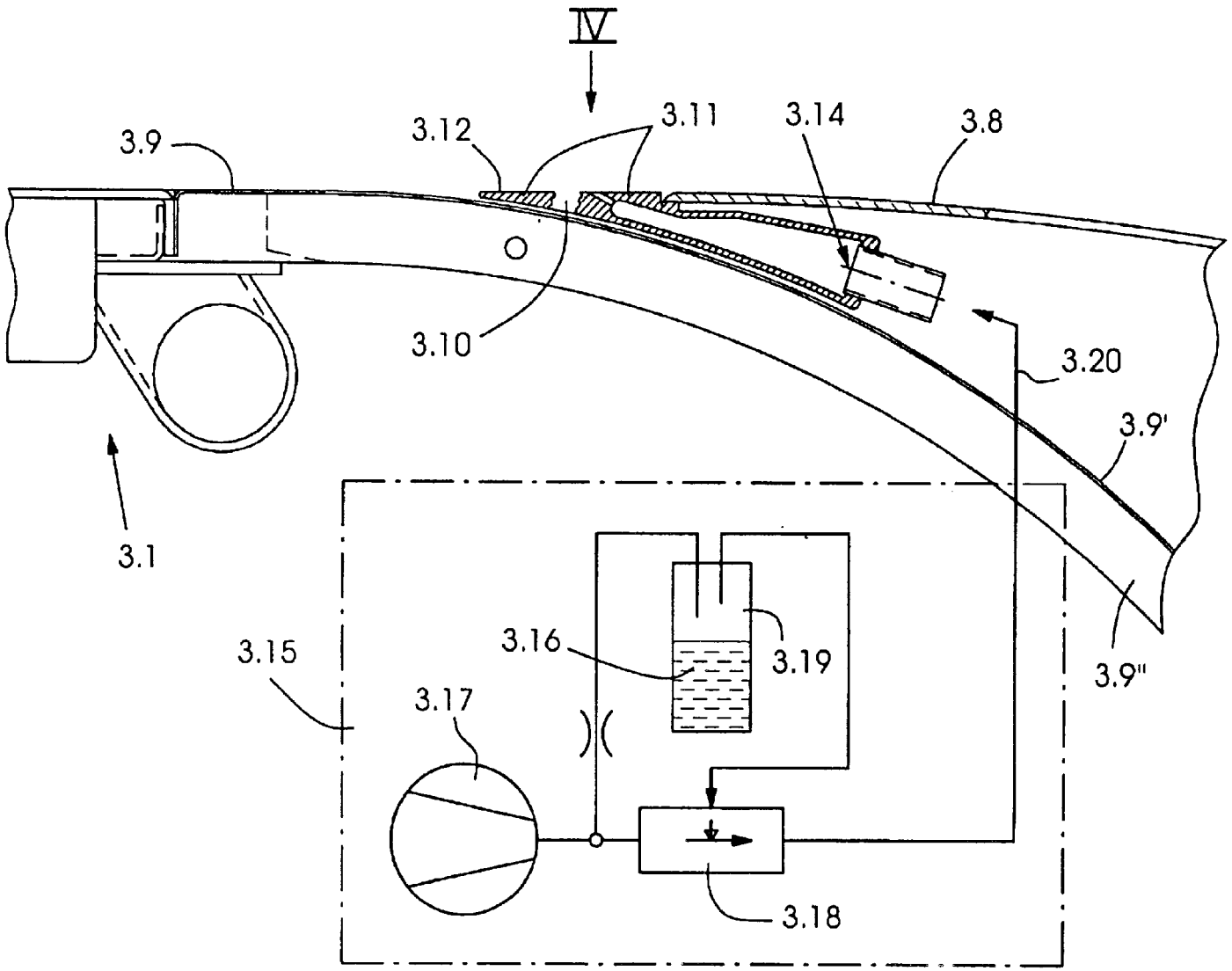
FIG. 2 is an enlarged, fragmentary view of a portion of FIG. 1, showing the wedge and the molded part inserted therein, and a supply system for utilizing a preferred configuration of the molded part for discharging a spray powder.

As is ascertainable from FIG. 2, the withdrawable guide surface 3.9 is formed on a guide element, in particular in the form of a guide plate 3.9', which is partially stored underneath one of the end sections of the stationary guide surface 3.8 facing towards the sheet brake 3.1. For the purpose of being adapted to the format of the processed sheets 2.2, the guide plate 3.9' is adjustable together with the sheet brake 3.1, i.e. it may be pulled out and pushed in, respectively, and is supported on a guide-plate guide 3.9".

Inserted into the pocket 3.10 is a molded part 3.11 formed with a third guide surface 3.12 that bridges over the pocket 3.10.

Figure 3:
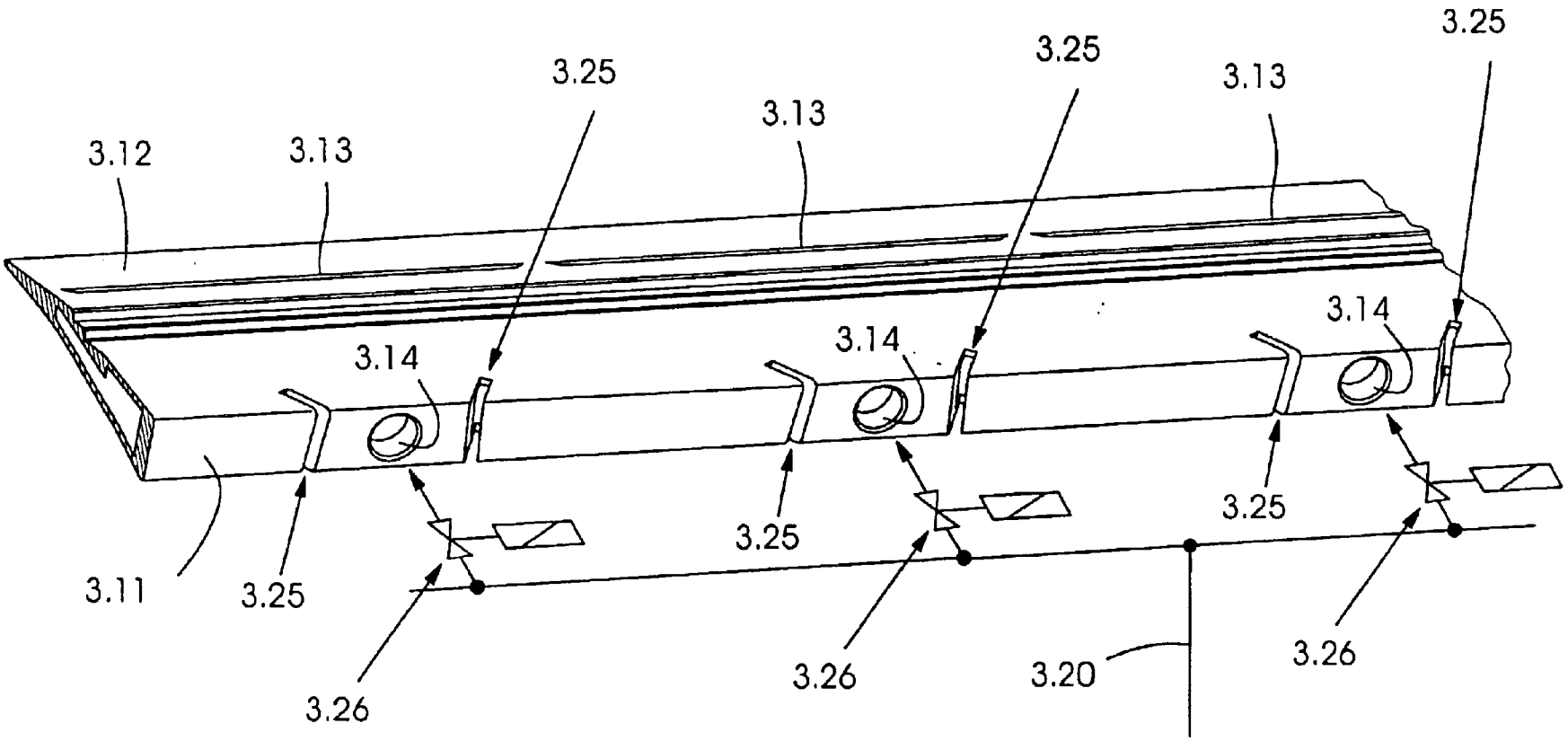
FIG. 3 is a fragmentary, further enlarged, rear, side and top perspective view of FIG. 2 showing a preferred configuration of the molded part in the form of a hollow profile.

FIG. 3 shows a preferred configuration of the molded part or molding 3.11 and the afore-mentioned preferred development or construction thereof. According to the preferred configuration, air outlet openings 3.13 passing through the third guide surface 3.12 formed on the molded part 3.11, and air inlet openings 3.14 communicating with the air outlet openings 3.13, are provided on the molded part 3.11.

In FIG. 2, there is diagrammatically illustrated a supply system 3.15 which is provided in the course of this further development and which, during operation, makes available a carrying or supporting air flow and a powdering agent 3.16 entrained by the air flow. The powder-bearing air flow is further suitably provided for connection fluidically to the air inlet openings 3.14.

To this extent, in conjunction with the molded part 3.11, a powdering device is provided which is advantageous inasmuch as it permits the underside of the sheets 2.2 to be powdered, i.e., from a particularly small spaced distance from the latter. This is done without having to intervene in the conceived construction of that section of the guiding device 3.7 which forms the stationary guide surface 3.8.

As is believed to be apparent from FIG. 2, the aforementioned supply system 3.15, in the case of the exemplary configuration at hand, includes an air-jet pump 3.18 which is connected to a blower 3.17, sucks in the powdering agent 3.16 stored in a dispersion chamber 3.19, together with a powerful air flow which is fed into the dispersion chamber 3.19 via a bypass, and swirls the powdering agent about and mixes it with a main air flow leaving the air-jet pump 3.18, the air flow mixed with the powdering agent then being supplied to the air inlet openings 3.14 via a feed line 3.20.

In a preferred configuration, the molded part 3.11 has the same chambers communicating with the air outlet openings 3.13 and the air inlet openings 3.14.

Figure 4:
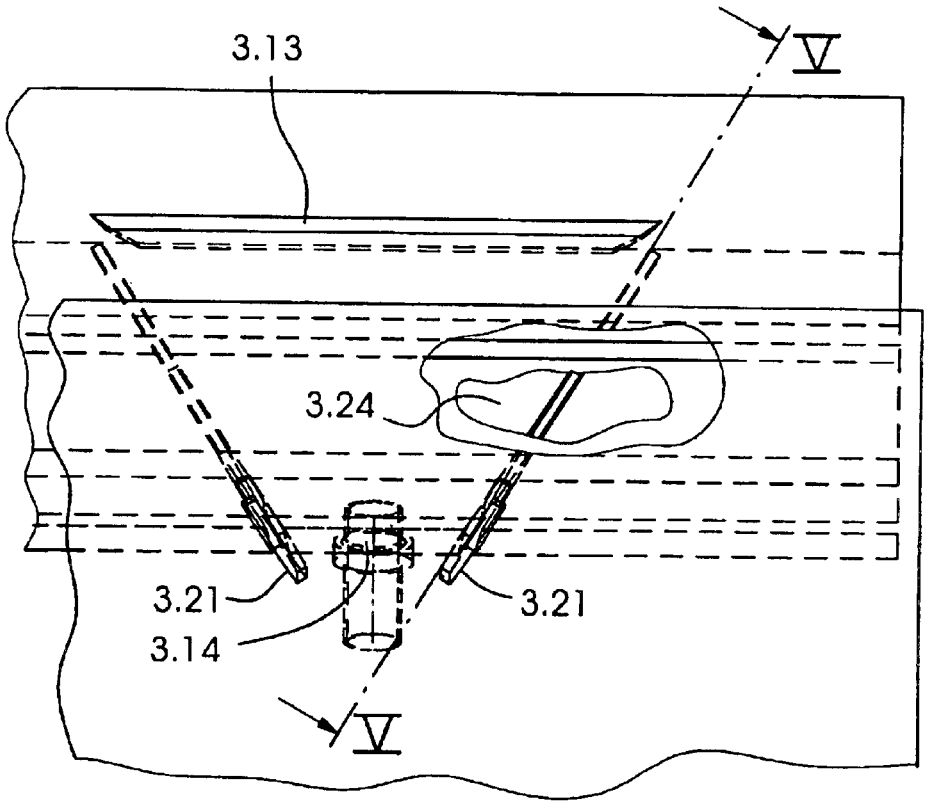
FIG. 4 is a fragmentary, top-plan view of a portion of FIG. 2, as seen in the direction of an arrow IV therein, showing a section of the molded part.

As is apparent from FIGS. 3 and 4, this is advantageously realized in terms of production by forming the molded part 3.11 as a hollow profile and by inserting dividing walls or partitions 3.21, not illustrated in FIG. 3, in the form of discrete components into the hollow profile, thereby subdividing the latter into the aforementioned chambers.

A respective chamber 3.24 can be seen in FIG. 4. The latter is bounded by the inner surfaces of the hollow profile, besides being bounded by the dividing walls or partitions 3.24, i.e., the dividing walls or partitions 3.24 have a contour in the aforementioned interior which fits snugly against the cross section of the inside width of the hollow profile.

As can be seen in particular in FIG. 3, for the purpose of mounting the dividing walls or partitions 3.21 formed as discrete components, slots 3.25 are formed in the hollow profile, through which the dividing walls or partitions 3.21 are slidable into the hollow profile forming the molded part 3.11.

No great demands have to be placed on mutual sealing of the chambers 3.24 formed in such a manner, so that adhesive bonding of the edge surfaces forming the contour of the dividing walls or partitions 3.21 to the inner surfaces of the hollow profile, in conjunction with suitable coordination of the slots with the wall thickness of the dividing walls or partitions 3.21, provides entirely adequate tightness, specifically even for the case given in the exemplary embodiment at hand, wherein the dividing walls or partitions 3.21 are inserted into the hollow profile obliquely with respect to the cross section of the latter, and the edge surfaces of the dividing walls or partitions 3.21 therefore do not rest snugly in an ideal manner on the internal cross-section of the inside width of the hollow profile along the entire contour.

Figure 5:
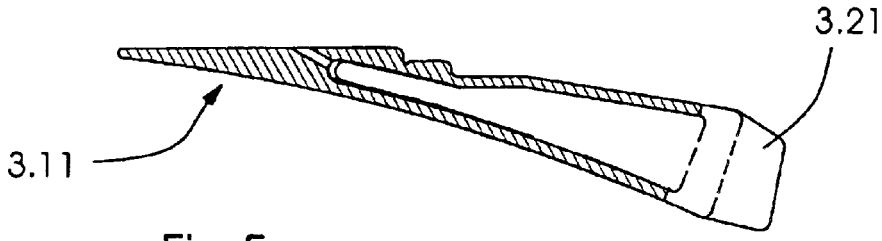
FIG. 5 is a sectional view of FIG. 4, which is taken along a line V—V therein in the direction of the arrows, and showing the molded part.

FIG. 5 illustrates how one of the dividing walls or partitions 3.21 rests snugly on the cross section of the inside width of the hollow profile.

As is ascertainable from FIG. 4 in conjunction with FIG. 3, the chambers 3.24 follow one another at short intervals along the hollow profile, and the air outlet openings 3.13, formed as slots as viewed in the longitudinal direction of the hollow profile in this exemplary embodiment, extend at least approximately from one dividing wall or partition 3.21 to the other of a respective one of the chambers 3.24. This offers, on one hand, a possibility of powdering the complete area of the sheets 2.2 and permits, on the other hand, by individually supplying the chambers 3.24 by the supply system 3.15, a powdering of the processed sheets 2.2 which is adjusted or matched to the format thereof.

Figure 6:
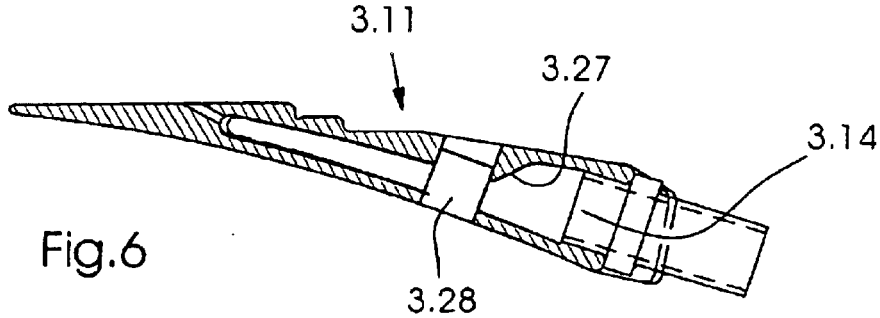
FIG. 6 is a view similar to that of FIG. 5, showing a further developed configuration of the molded part.

Complete-area powdering of the sheets 2.2 further benefits from a further development wherein the air flows passing through the chambers 3.24 and laden with the powdering agent 3.16 are swirled in the chambers 3.24. For this purpose, a respective chamber 3.24 is provided with a baffle surface 3.27, which faces towards the air inlet opening 3.14 of the chamber 3.24 (note FIG. 6). Furthermore, an obstruction 3.28 to flow is inserted into a respective one of the chambers 3.24 and, in the example at hand, is formed as a bolt around which the air flow passing through the chamber 3.24 must flow.

As is believed to be apparent from FIG. 3, the feed line 3.20 is branched, and a respective branch therefrom leads to a respective one of the air inlet openings 3.14 and thus opens in a respective one of the chambers 3.24. Overall, to this extent, a discharge of the powdering agent 3.16, which is adapted to the format of the processed sheets 2.2, is advantageously possible due to the interruption of the fluidic connection of the feed line 3.20 to those chambers 3.24 which lie outside the format of the respectively processed sheets.

In this regard, in a preferred configuration, the end section of the branch of the feed line 3.20 leading to a respective end section of the hollow profile placed outside the smallest format can be closed, for example, by solenoid valves 3.26.

We claim:

1. A sheet-processing rotary printing press, comprising:

a sheet guiding device for guiding sheets to be pulled over said sheet guiding device in a processing direction;

said guiding device having a stationary first guide surface and a second guide surface to be withdrawn, said second guide surface following said first guide surface in said processing direction, and said second guide surface and said first guide surface together forming a pocket; and said guiding device having a molded part received in said pocket and forming a third guide surface bridging over said pocket.

2. The rotary printing press according to claim 1, wherein said molded part has air outlet openings passing through said third guide surface and air inlet openings communicating with said air outlet openings.

3. The rotary printing press according to claim 2, further comprising a supply system for providing a carrying-air flow and a powdering agent entrained thereby during operation and for further providing a fluidic connection to said air inlet openings.

4. The rotary printing press according to claim 2, wherein said molded part has chambers communicating with said air outlet openings and said air inlet openings.

5. The rotary printing press according to claim 2, wherein said molded part has a hollow profile and dividing walls in said hollow molded part for subdividing said hollow molded part into chambers communicating with said air outlet openings and said air inlet openings.

6. The rotary printing press according to claim 5, wherein said molded part has slots through which said dividing walls are insertable into said molded part.

7. The rotary printing press according to claim 4, wherein a respective one of said chambers has a baffle surface facing towards a respective air inlet opening for said one chamber.

8. The rotary printing press according to claim 4, further comprising a flow obstruction in a respective one of said chambers.

* * * * *